US010605021B2

(12) United States Patent
Le

(10) Patent No.: US 10,605,021 B2
(45) Date of Patent: Mar. 31, 2020

(54) INSTALLATION AND RETRIEVAL OF WELL PRESSURE CONTROL DEVICE RELEASABLE ASSEMBLY

(71) Applicant: WEATHERFORD TECHNOLOGY HOLDINGS, LLC, Houston, TX (US)

(72) Inventor: Tuong T. Le, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 167 days.

(21) Appl. No.: 15/783,884

(22) Filed: Oct. 13, 2017

(65) Prior Publication Data

US 2019/0112886 A1 Apr. 18, 2019

(51) Int. Cl.

| | |
|---|---|
| ***E21B 23/10*** | (2006.01) |
| ***E21B 23/00*** | (2006.01) |
| ***E21B 33/08*** | (2006.01) |
| ***E21B 33/10*** | (2006.01) |

(52) U.S. Cl.

CPC ..... *E21B 23/10* (2013.01); *E21B 23/00* (2013.01); *E21B 23/006* (2013.01); *E21B 33/085* (2013.01); *E21B 33/10* (2013.01)

(58) Field of Classification Search

CPC ..... E21B 23/006; E21B 23/02; E21B 33/085; E21B 33/10; E21B 33/03; E21B 33/04; E21B 33/08; E21B 33/02

See application file for complete search history.

(56) References Cited

U.S. PATENT DOCUMENTS

| | | | | |
|---|---|---|---|---|
| 4,295,528 A | | 10/1981 | Carmody | |
| 4,353,420 A | * | 10/1982 | Miller | E21B 23/06 166/113 |
| 4,488,596 A | | 12/1984 | Akkerman | |
| 4,811,784 A | * | 3/1989 | Theiss | E21B 33/04 166/208 |
| 5,066,060 A | * | 11/1991 | Cooksey | E21B 17/06 166/178 |
| 5,069,288 A | * | 12/1991 | Singeetham | E21B 33/043 166/348 |

(Continued)

OTHER PUBLICATIONS

Office Action dated Jan. 16, 2018 for U.S. Appl. No. 15/378,213, 16 pages.

(Continued)

*Primary Examiner* — Jennifer H Gay
(74) *Attorney, Agent, or Firm* — Smith IP Services, P.C.

(57) ABSTRACT

A method can include latching a well pressure control device releasable assembly in an outer housing, and then rotating a tubular string, thereby disengaging an engagement lug from an engagement profile. A well system can include a pressure control device including a releasable assembly and an outer housing, and a running tool including an engagement lug releasably engaged with an engagement profile of the releasable assembly, and a clutch device that resists relative rotation between the engagement lug and an inner mandrel. A pressure control device can include a bearing assembly that rotatably supports an annular seal relative to an outer case, and an extension attached to the outer case, the extension having an engagement profile including at least two longitudinally elongated sections, one section extending to an end of the extension, and another section being blocked from the end of the extension.

17 Claims, 10 Drawing Sheets

(56) References Cited

U.S. PATENT DOCUMENTS

| | | | | |
|---|---|---|---|---|
| 5,404,955 | A * | 4/1995 | Echols, III | E21B 23/00 166/122 |
| 5,735,344 | A | 4/1998 | Duncan | |
| 5,775,433 | A | 7/1998 | Hammett et al. | |
| 7,096,956 | B2 * | 8/2006 | Reimert | E21B 23/04 166/348 |
| 7,159,669 | B2 * | 1/2007 | Bourgoyne | E21B 21/001 166/382 |
| 7,926,593 | B2 | 4/2011 | Bailey et al. | |
| 9,010,433 | B2 * | 4/2015 | Rios, III | E21B 33/038 166/338 |
| 9,371,697 | B2 | 6/2016 | Gray et al. | |
| 9,784,073 | B2 * | 10/2017 | Bailey | E21B 21/08 |
| 9,845,650 | B2 * | 12/2017 | Evans | E21B 23/01 |
| 9,957,759 | B2 * | 5/2018 | Robichaux | E21B 17/05 |
| 10,287,838 | B2 * | 5/2019 | Van Bilderbeek | E21B 33/04 |
| 2003/0106712 | A1 * | 6/2003 | Bourgoyne | E21B 21/001 175/5 |
| 2008/0210471 | A1 * | 9/2008 | Bailey | E21B 21/08 175/48 |
| 2010/0126776 | A1 * | 5/2010 | Trevino | E21B 7/20 175/61 |
| 2012/0013133 | A1 | 1/2012 | Rios, III et al. | |
| 2014/0202710 | A1 | 7/2014 | Hales et al. | |
| 2015/0136393 | A1 * | 5/2015 | Turley | E21B 43/10 166/285 |
| 2015/0136394 | A1 * | 5/2015 | Turley | E21B 43/10 166/285 |
| 2015/0136407 | A1 * | 5/2015 | Bailey | E21B 21/08 166/335 |
| 2015/0345256 | A1 | 12/2015 | Tulloch | |
| 2016/0076329 | A1 * | 3/2016 | Nguyen | E21B 33/0415 166/77.52 |
| 2016/0222748 | A1 * | 8/2016 | Van Bilderbeek | E21B 23/04 |
| 2016/0348450 | A1 * | 12/2016 | Robichaux | E21B 17/05 |
| 2017/0044858 | A1 * | 2/2017 | Evans | E21B 23/01 |
| 2017/0114602 | A1 * | 4/2017 | Grace | E21B 17/02 |
| 2018/0163493 | A1 * | 6/2018 | Le | E21B 23/02 |
| 2018/0163494 | A1 * | 6/2018 | Le | E21B 33/03 |
| 2019/0112886 | A1 * | 4/2019 | Le | E21B 23/10 |
| 2019/0112897 | A1 * | 4/2019 | Le | E21B 33/12 |

OTHER PUBLICATIONS

International Search Report with Written Opinion dated Jan. 24, 2019 for PCT/US2018/053483, 12 pages.

Office Action dated Jun. 11, 2018 for U.S. Appl. No. 15/378,213, 19 pages.

International Search Report with Written Opinion dated Mar. 28, 2018 for PCT Patent Application No. PCT/US2017/065510, 16 pages.

International Search Report with Written Opinion dated Mar. 28, 2018 for PCT Patent Application No. PCT/US2017/065512, 17 pages.

Specification and drawings for U.S. Appl. No. 15/378,213, filed Dec. 14, 2016, 80 pages.

Office Action dated Mar. 28, 2019 for U.S. Appl. No. 15/378,213, 14 pages.

* cited by examiner

INSTALLATION AND RETRIEVAL OF WELL PRESSURE CONTROL DEVICE RELEASABLE ASSEMBLY

BACKGROUND

This disclosure relates generally to equipment utilized and operations performed in conjunction with a subterranean well and, in examples described below, more particularly provides for installing and retrieving a releasable assembly of a pressure control device.

A pressure control device is typically used to seal off an annular space between an outer tubular structure (such as, a riser, a housing on a subsea structure in a riser-less system, or a housing attached to a surface wellhead) and an inner tubular (such as, a drill string, a test string, etc.). At times it may be desired for components (such as, bearings, seals, etc.) of the pressure control device to be retrieved from, or installed in, an outer housing (such as, a riser housing).

Therefore, it will be appreciated that advancements are continually needed in the arts of installing and retrieving releasable assemblies of pressure control devices. In particular, it would be desirable to provide for convenient and efficient installation and retrieval of pressure control device components respectively into and out of an outer housing.

DETAILED DESCRIPTION

Figure 1:
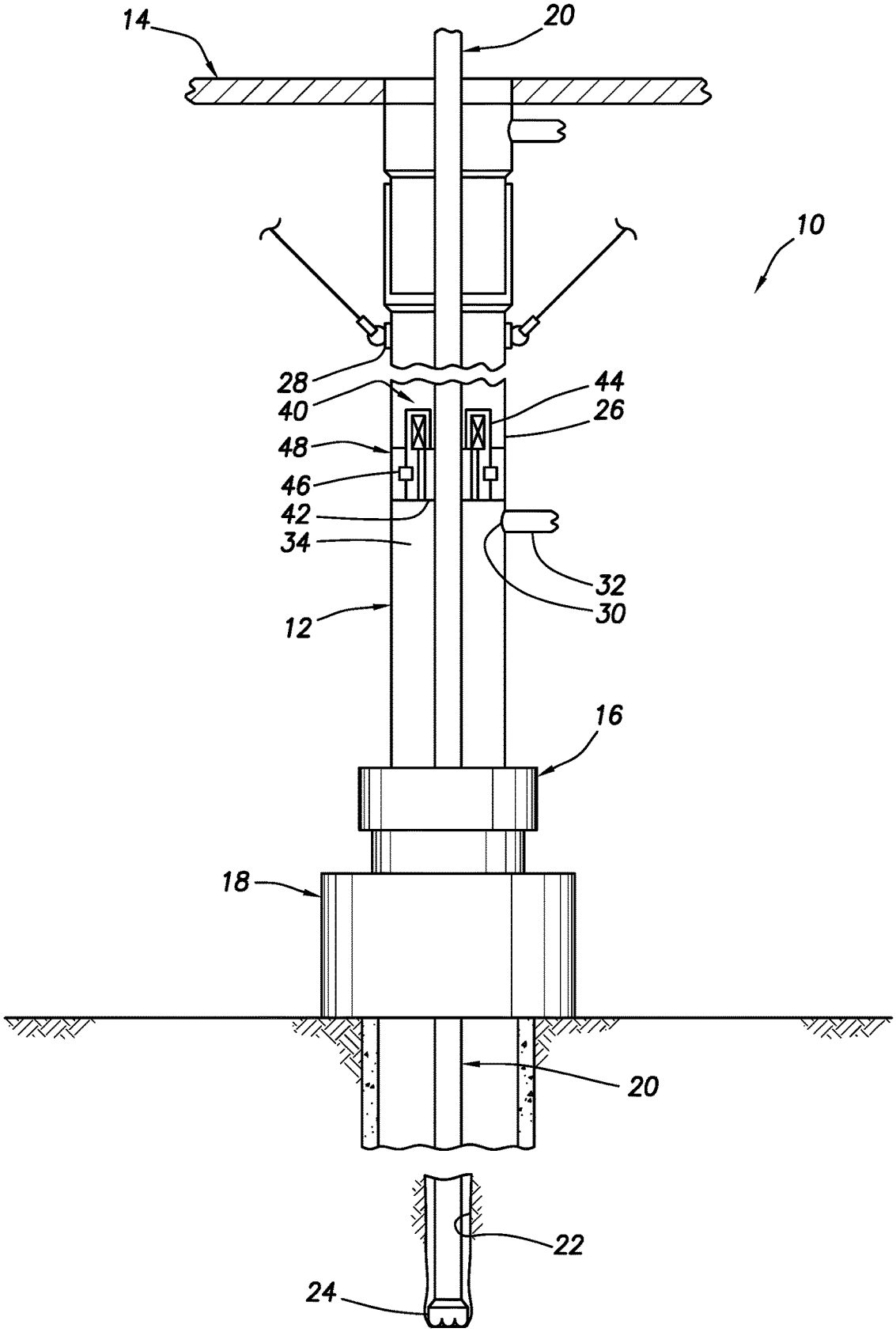
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method as described herein and/or depicted in the drawings.

In the system 10 as depicted in FIG. 1, a generally tubular riser string 12 extends between a water-based rig 14 and a lower marine riser package 16 above a subsea wellhead installation 18 (including, for example, various blowout preventers, hangers, fluid connections, etc.). However, in other examples, the principles of this disclosure could be practiced with a land-based rig, or with a riser-less installation.

In the FIG. 1 example, a tubular string 20 (such as, a jointed or continuous drill string, a coiled tubing string, etc.) extends through the riser string 12 and is used to drill a wellbore 22 into the earth. For this purpose, a drill bit 24 is connected at a lower or distal end of the tubular string 20.

The drill bit 24 may be rotated by rotating the tubular string 20 (for example, using a top drive or rotary table of the rig 14), and/or a drilling motor (not shown) may be connected in the tubular string 20 above the drill bit 24. However, the principles of this disclosure could be utilized in well operations other than drilling operations. Thus, it should be appreciated that the scope of this disclosure is not limited to any of the details of the tubular string 20 or wellbore 22 as depicted in the drawings or as described herein.

The riser string 12 depicted in FIG. 1 includes an outer riser housing 26 connected in the riser string 12 below a tensioner ring 28 suspended from the rig 14. In other examples, the riser housing 26 could be connected above the tensioner ring 28, or could be otherwise positioned (such as, in the wellhead installation 18 in a riser-less configuration). Thus, the scope of this disclosure is not limited to any particular details of the riser string 12 or riser housing 26 as described herein or depicted in the drawings.

The riser housing 26 includes a side port 30 that provides for fluid communication between a conduit 32 and an annulus 34 formed radially between the riser string 12 and the tubular string 20. In a typical drilling operation, drilling fluid can be circulated from the rig 14 downward through the tubular string 20, outward from the drill bit 24, upward through the annulus 34, and return to the rig 14 via the conduit 32.

As depicted in FIG. 1, a releasable assembly 40 is installed in the riser housing 26. The releasable assembly 40 in this example is of the type known to those skilled in the art as a rotating control device. The releasable assembly 40 and the outer riser housing 26 comprise a pressure control device 48.

However, the scope of this disclosure is not limited to installation or retrieval of any particular type of releasable assembly in the riser housing 26. In other examples, the releasable assembly 40 could comprise a portion of a non-rotating pressure control device (e.g., having one or more non-rotating annular seals for engagement with the tubular string 20).

In the FIG. 1 example, the releasable assembly 40 includes one or more annular seals 42 that seal off the annulus 34 above the side port 30. In this example, the annular seals 42 are configured to sealingly engage an exterior of the tubular string 20. The annular seals 42 may be of a type known to those skilled in the art as "passive," "active" or a combination of passive and active. The scope of this disclosure is not limited to use of any particular type of annular seal.

Rotation of the annular seals 42 relative to the riser housing 26 is provided for by a bearing assembly 44 of the releasable assembly 40. The annular seals 42 and bearing assembly 44 are releasably secured in the riser housing 26 by a latch 46. The latch 46 permits the annular seals 42 and/or the bearing assembly 44 to be installed in, or retrieved from, the riser housing 26 when desired, for example, to service or replace the seals 42 and/or bearing assembly 44.

Various components of the latch 46 may be part of, or integral to, the riser housing 26, the releasable assembly 40, or a combination thereof. The scope of this disclosure is not limited to any particular location(s) or configuration of any components or combination of components of the latch 46.

Figure 2:
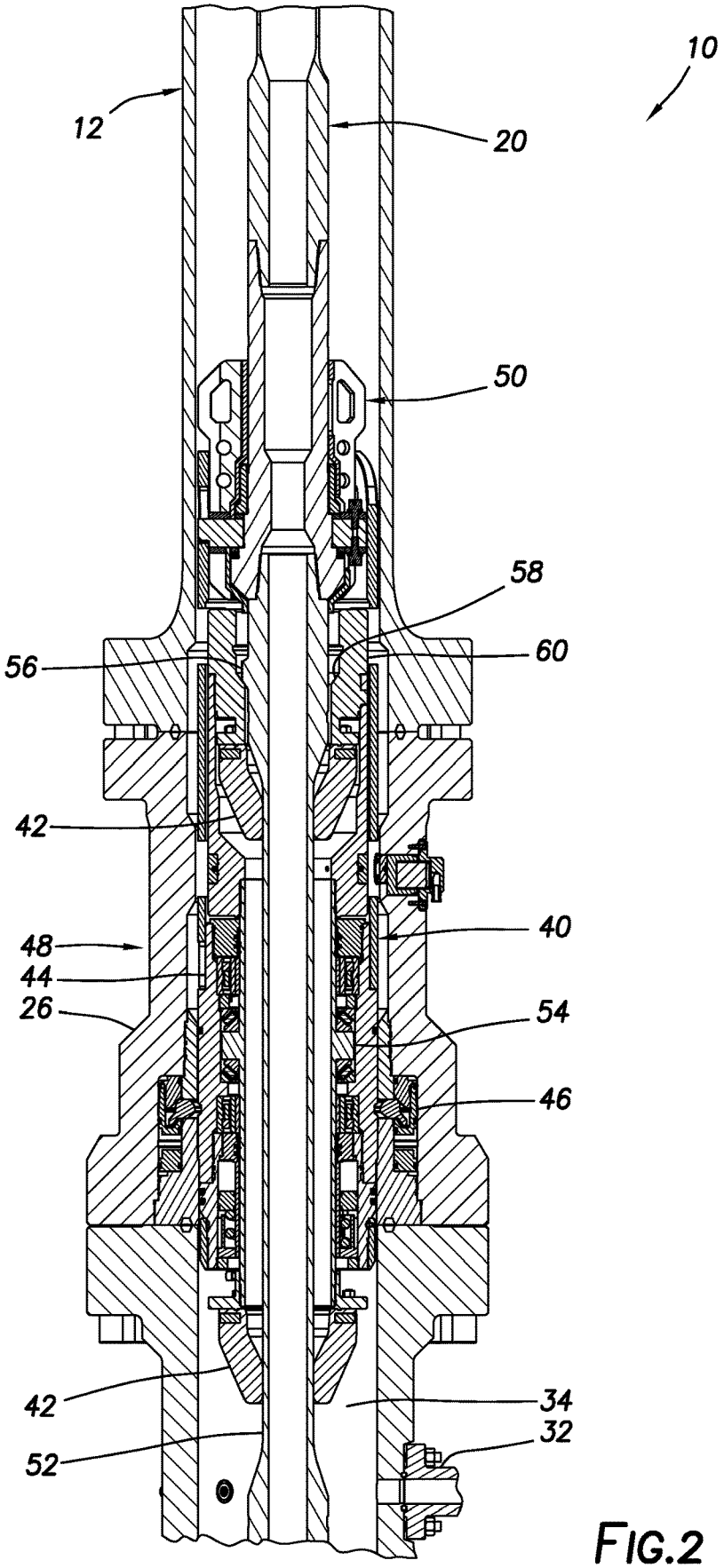
FIG. 2 is a representative cross-sectional view of an example of a releasable assembly conveyed by an example of a running tool in the well system and method of FIG. 1, in which the releasable assembly and the running tool can embody the principles of this disclosure.

Referring additionally now to FIG. 2, more detailed examples of the pressure control device 48 and a running tool 50 are representatively illustrated. The pressure control device 48 and running tool 50 examples of FIG. 2 are described below as they may be used in the system 10 and method of FIG. 1, but the pressure control device and/or the running tool may be used in other systems or methods, in keeping with the principles of this disclosure.

The running tool 50 is used to install and retrieve the releasable assembly 40. In this example, the running tool 50 is connected in the tubular string 20, so that it is a portion of the tubular string. Note that the tubular string 20 is not necessarily configured as the tubular string depicted in FIG. 1 (for example, the drill bit 24 may not be connected at the downhole end of the tubular string when the releasable assembly 40 is installed or retrieved).

As depicted in FIG. 2, the releasable assembly 40 is appropriately positioned in the outer housing 26, but the latch 46 is not activated to secure the releasable assembly to the outer housing. Thus, in the FIG. 2 configuration, the releasable assembly 40 can be retrieved from the outer housing 26, or the latch 46 can be activated to secure the releasable assembly in the outer housing. The latch 46 in this example is similar to that described in U.S. Pat. No. 9,010,433, although other types of latches may be used in other examples.

A generally tubular extension sub 52 is connected to the running tool 50 and extends downwardly through the releasable assembly 40. The annular seals 42 are sealingly engaged with the extension sub 52.

The annular seals 42 are attached to an inner generally tubular mandrel 54 of the releasable assembly. The bearing assembly 44 provides for rotation of the annular seals 42 and the inner mandrel 54 in the releasable assembly 40. Although two annular seals 42 are depicted in FIG. 2, any number of annular seals may be used in keeping with the scope of this disclosure.

In an installation operation, the running tool 50 can be disengaged from the releasable assembly 40 after the latch 46 has been activated to secure the releasable assembly in the outer housing 26. The tubular string 20, including the running tool 50 and extension sub 52, can then be retrieved from the riser string 12. As described more fully below, the disengagement of the running tool 50 can be conveniently performed by rotating the tubular string 20 (for example, using a top drive or rotary table at surface) while picking up on the tubular string.

In a retrieval operation, the tubular string 20 (with the running tool 50 and extension sub 52 connected therein) can be run in, until projections 56 on the extension sub engage an internal shoulder 58 in an upper seal carrier 60 used to attach the upper annular seal 42 to the inner mandrel 54. As a result, the running tool 50 will engage the releasable assembly 40. The latch 46 can then be deactivated, and the releasable assembly 40 can be retrieved to the surface, conveyed on the running tool 50.

Figure 3:
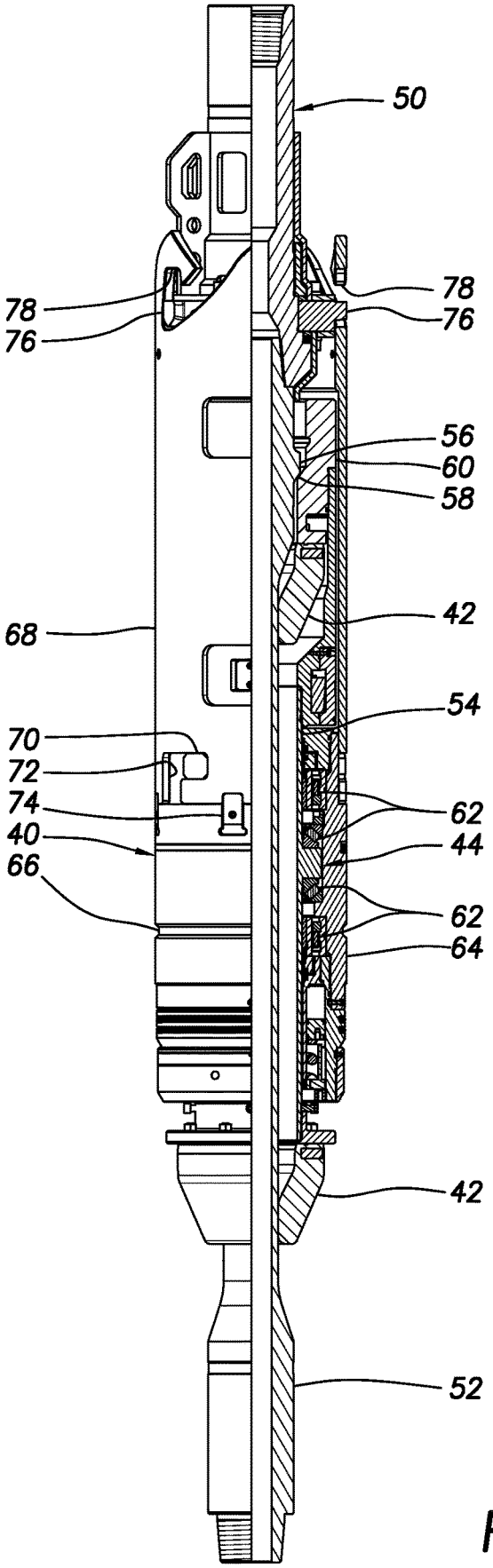
FIG. 3 is a representative partially cross-sectional view of the releasable assembly and the running tool.

Referring additionally now to FIG. 3, the releasable assembly 40, running tool 50 and extension sub 52 are representatively illustrated, apart from the remainder of the system 10. In this view, it may be seen that the bearing assembly 44 includes various bearings 62 that rotationally support the inner mandrel 54 within an outer case 64.

The outer case 64 in this example has an annular latch profile 66 formed in an external surface of the outer case. The latch profile 66 can be engaged by the latch 46 (see FIG. 2) to secure the releasable assembly 40 in the outer housing 26.

A generally tubular extension 68 is connected to the outer case 64 and extends upwardly from the bearing assembly 44, outwardly surrounding the upper annular seal 42 and seal carrier 60. To secure the extension 68 to the outer case 64, external lugs or dogs 70 on the outer case 64 are engaged with "L"-shaped slots 72 formed at a lower end of the extension. Disengagement of the dogs 70 from the slots 72 is prevented by tabs 74 (which prevent rotation of the extension 68 relative to the outer case 64).

The running tool 50 is engaged with the extension 68 at an upper end of the extension. In this example, dogs or lugs 76 extending radially outward from the running tool 50 are engaged with engagement profiles 78 formed at the upper end of the extension 68.

Figure 4:
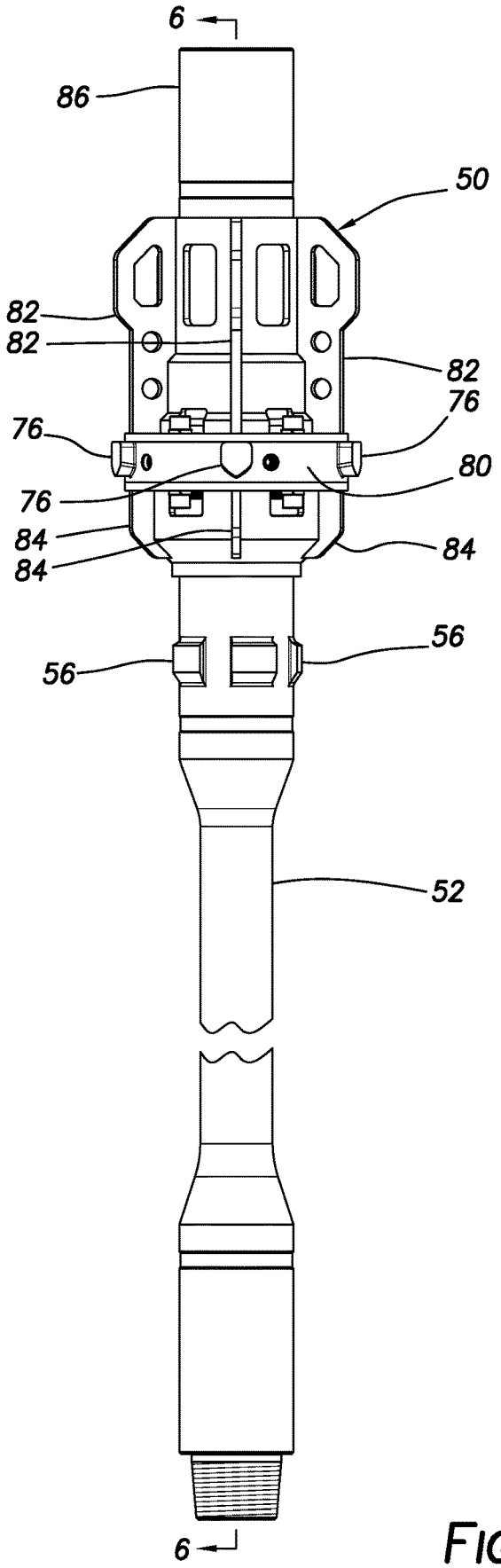
FIG. 4 is a representative elevational view of the running tool with an extension sub.
Figure 5:
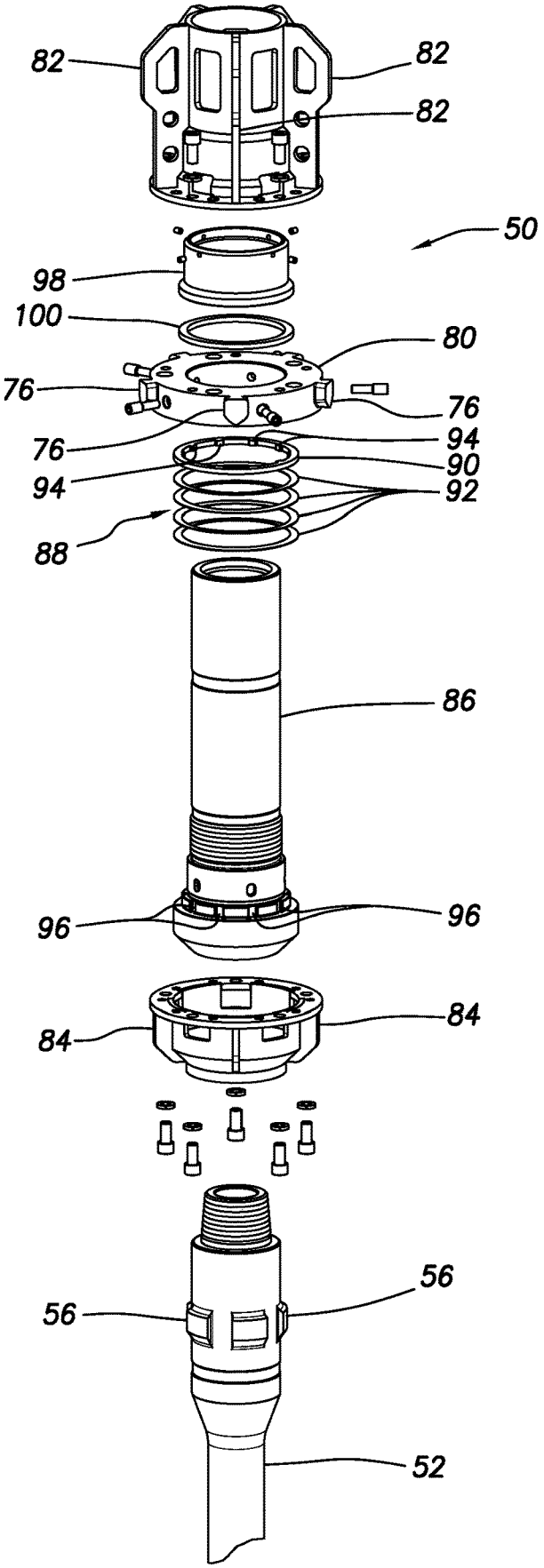
FIG. 5 is a representative exploded view of the running tool.

Referring additionally now to FIGS. 4 & 5, elevational and exploded views of the running tool 50 and extension sub 52 are representatively illustrated. In these views, it may be seen that the lugs 76 extend outward from an annular drive hub 80.

A series of circumferentially spaced and radially extending upper fins 82 are secured to an upper surface of the drive hub 80, and a series of circumferentially spaced and radially extending lower fins 84 are secured to a lower surface of the drive hub. The fins 82, 84 centralize the running tool 50 relative to the riser string 12 and the extension 68 (see FIGS. 2 & 3).

The drive hub 80 surrounds a generally tubular inner mandrel 86 of the running tool 50. In this example, the inner mandrel 86 is also internally threaded at its opposite ends to provide for connection of the running tool 50 in the tubular string 20 (see FIG. 2).

Relative rotation is permitted between the drive hub 80 and the inner mandrel 86. Thus, the lugs 76 are also rotatable relative to the inner mandrel 86. As depicted in FIGS. 4 & 5, the lugs 76 are integrally formed on the drive hub 80, but in other examples the lugs could be separately formed and attached to the drive hub, if desired. Thus, the scope of this disclosure is not limited to any particular details of the running tool 50 as described herein or depicted in the drawings.

Frictional resistance to relative rotation between the drive hub 80 and the inner mandrel 86 is provided by a clutch device 88 (see FIG. 5). In this example, the clutch device 88 includes at least one clutch ring 90 biased into sliding contact with a lower surface of the drive hub 80 by a series of biasing devices 92 (such as, spring washers, Bellville springs, wave springs, etc.).

An inner circumference of the clutch ring 90 has projections 94 formed thereon, which are configured to engage complementarily shaped circumferentially spaced slots 96 formed on the inner mandrel 86. In this manner, the clutch ring 90 is constrained to rotate with the inner mandrel 86 (that is, relative rotation between the clutch ring and the inner mandrel is prevented).

An internally threaded sleeve 98 and a bushing 100 are used to secure the drive hub 80 on the inner mandrel 86, and to compress the biasing devices 92, so that the clutch ring 90 is biased into contact with the lower surface of the drive hub. Since the clutch ring 90 is constrained to rotate with the inner mandrel 86, and the clutch ring is biased into contact with the drive hub 80, friction between the clutch ring and the lower surface of the drive hub will resist relative rotation between the drive hub and the inner mandrel.

Figure 6:
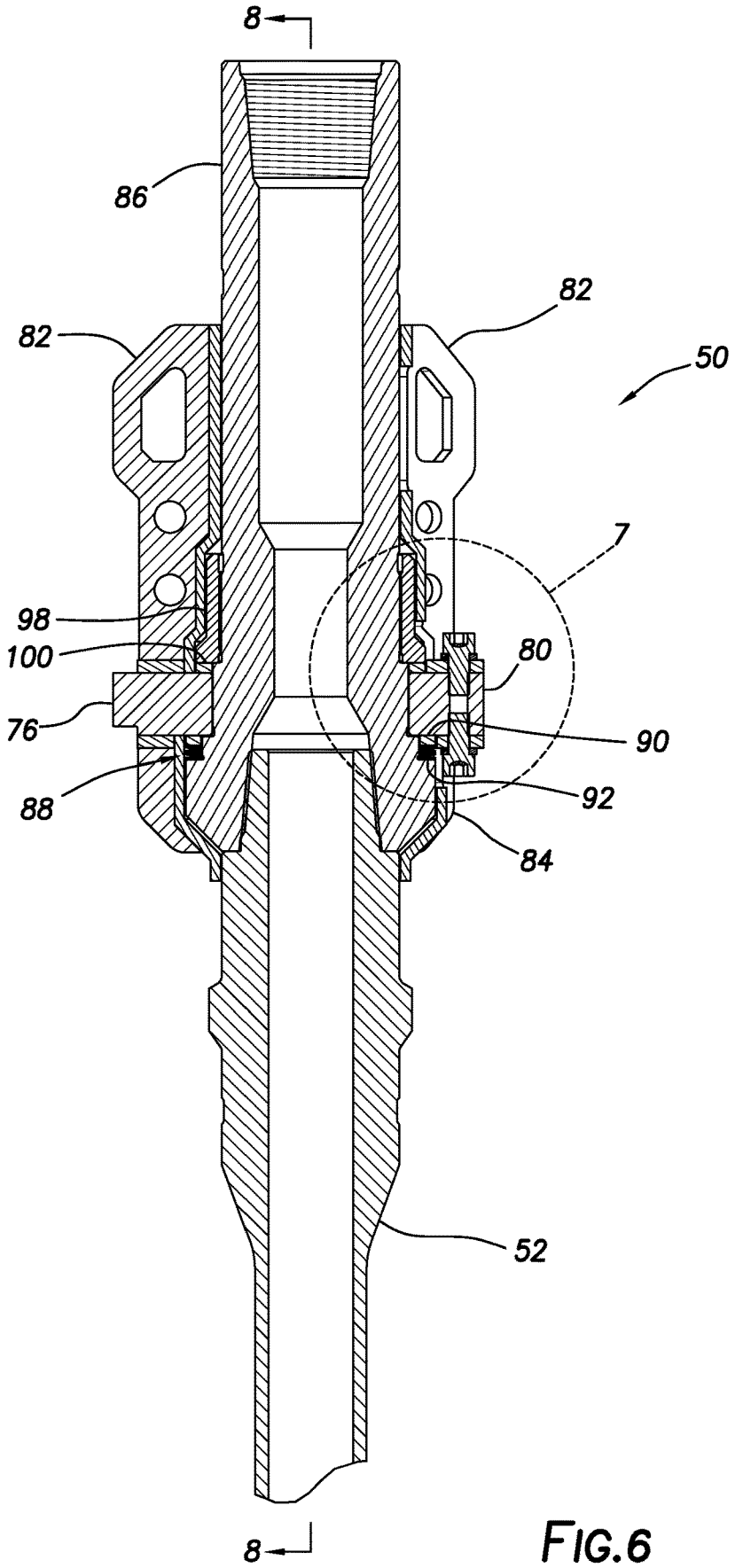
FIG. 6 is a representative cross-sectional view of the running tool and an upper portion of the extension sub, taken along line 6-6 of FIG. 4.
Figure 7:
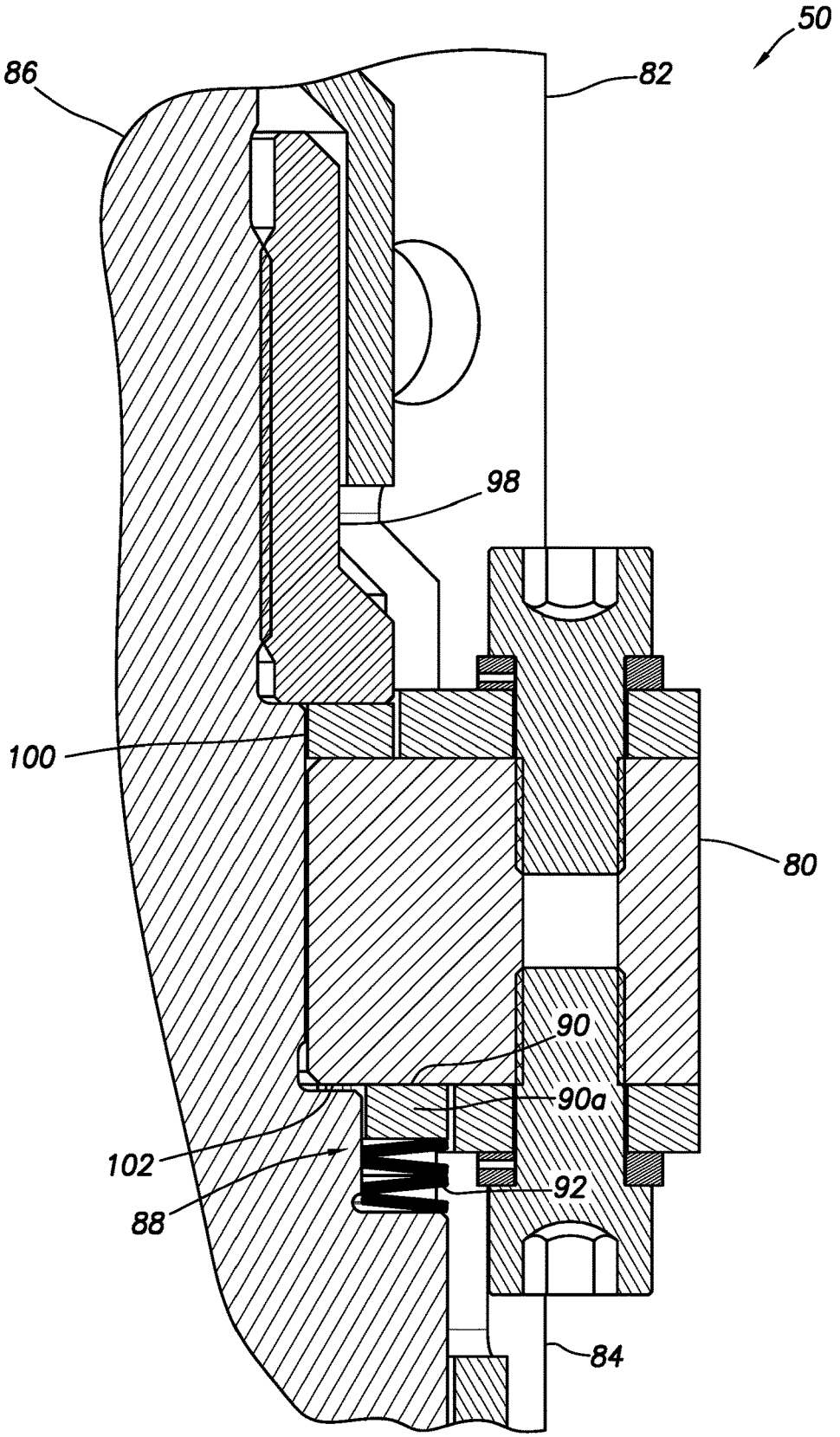
FIG. 7 is a representative cross-sectional view of a drive hub portion of the running tool, indicated as detail 7 in FIG. 6.

Referring additionally now to FIGS. 6 & 7, cross-sectional views of the running tool 50 and clutch device 88 are representatively illustrated. In FIG. 7, the manner in which threading of the sleeve 98 onto the inner mandrel 86 compresses the biasing devices 92 in this example may be more clearly seen.

In other examples, the biasing devices 92 could be compressed by other means, or other types of devices may be used to bias the clutch ring 90 against a lower surface 102 (or other surface) of the drive hub 80. Thus, the scope of this disclosure is not limited to any particular details of the clutch device 88, drive hub 80, sleeve 98, inner mandrel 86 or other components of the running tool 50.

The clutch ring 90 comprises a friction enhancing material 90*a* that is selected for its capability of consistently providing enhanced sliding friction against the surface 102 of the drive hub 80 in the riser string 12 interior environment. The clutch ring 90 may be made completely of the material 90*a*, or the material 90*a* could be applied only to a surface of the clutch ring which contacts the drive hub surface 102. Alternatively, or in addition, the friction enhancing material 90*a* could be applied to the lower surface 102 of the drive hub 80.

Note that the clutch device 88 as described herein and depicted in the drawings is merely one example of a wide variety of different types of frictional drag devices that may be used to provide resistance to relative rotation between the drive hub 80 and the inner mandrel 86. Thus, the scope of this disclosure is not limited to any particular device, configuration, manner or technique for resisting such relative rotation.

Figure 8:
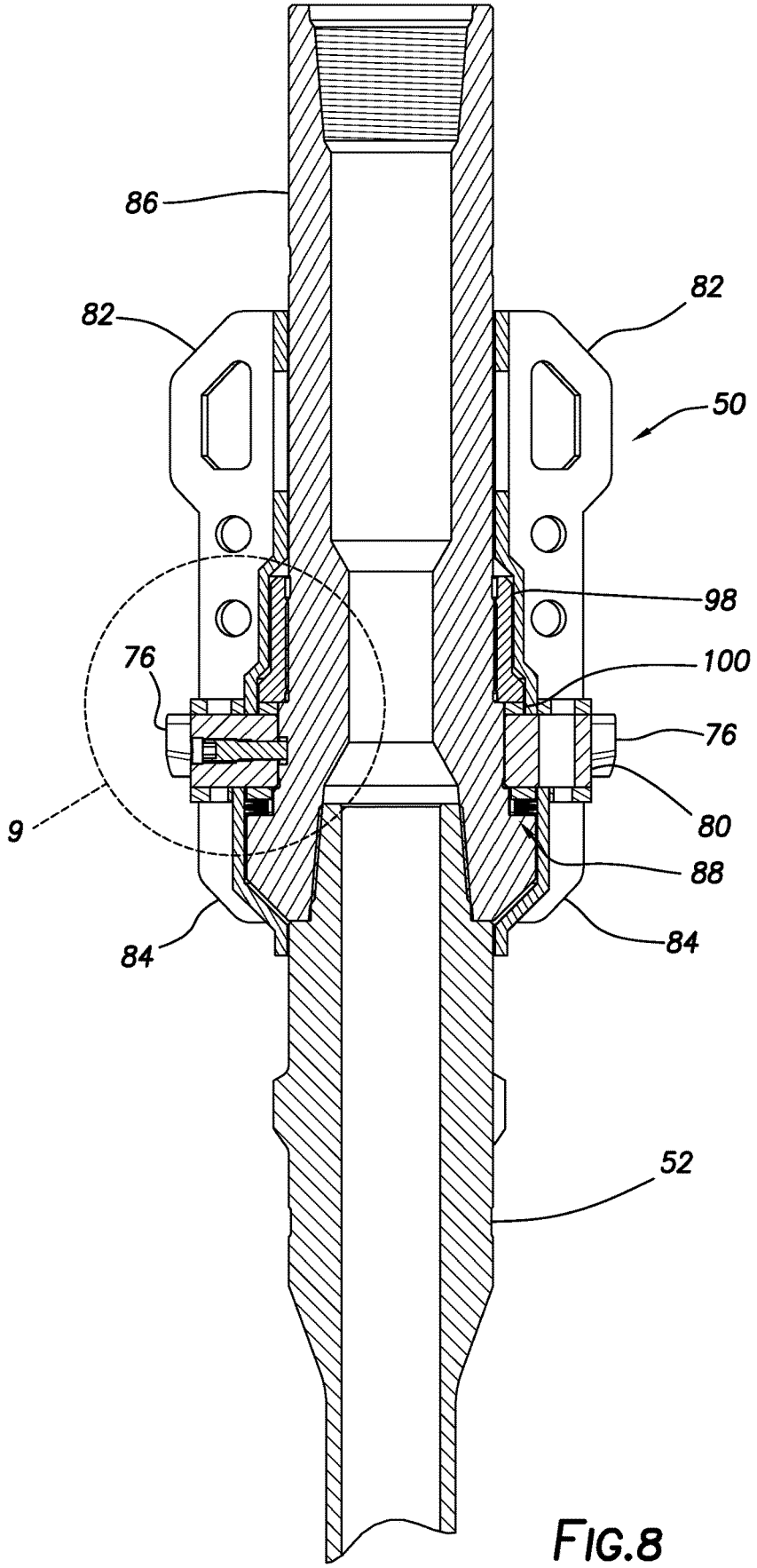
FIG. 8 is a representative cross-sectional view of the running tool and an upper portion of the extension sub, taken along line 8-8 of FIG. 6.
Figure 9:
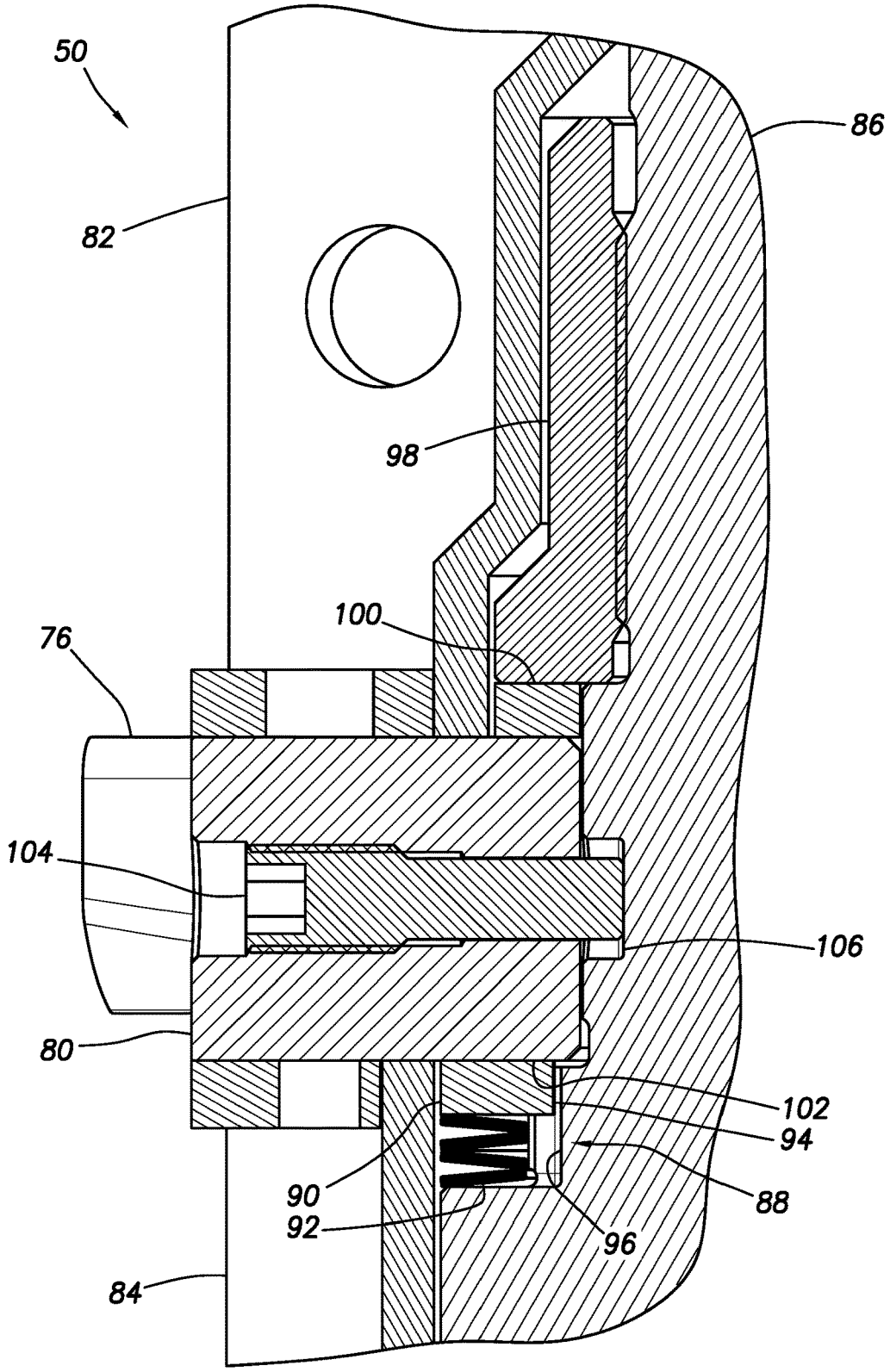
FIG. 9 is a representative cross-sectional view of the drive hub portion of the running tool, indicated as detail 9 in FIG. 8.

Referring additionally now to FIGS. 8 & 9, additional cross-sectional views of the running tool 50 and clutch device 88 are representatively illustrated. In FIG. 9, it may be more clearly seen that relative rotation between the drive hub 80 and the inner mandrel 86 may be entirely prevented, when desired, by installing one or more fasteners or pins 104 through the drive hub and into corresponding one or more recesses 106 formed on the inner mandrel 86.

Such prevention of relative rotation between the drive hub 80 and the inner mandrel 86 can be useful when connecting the running tool 50 to the releasable assembly 40, so that the lugs 76 are engaged with the engagement profiles 78 of the extension 68 (see FIG. 3), prior to installing the releasable assembly. In that case, the fasteners or pins 104 are removed prior to the running tool 50 and the releasable assembly 40 being inserted into the riser string 12 (see FIG. 2).

Figure 10:
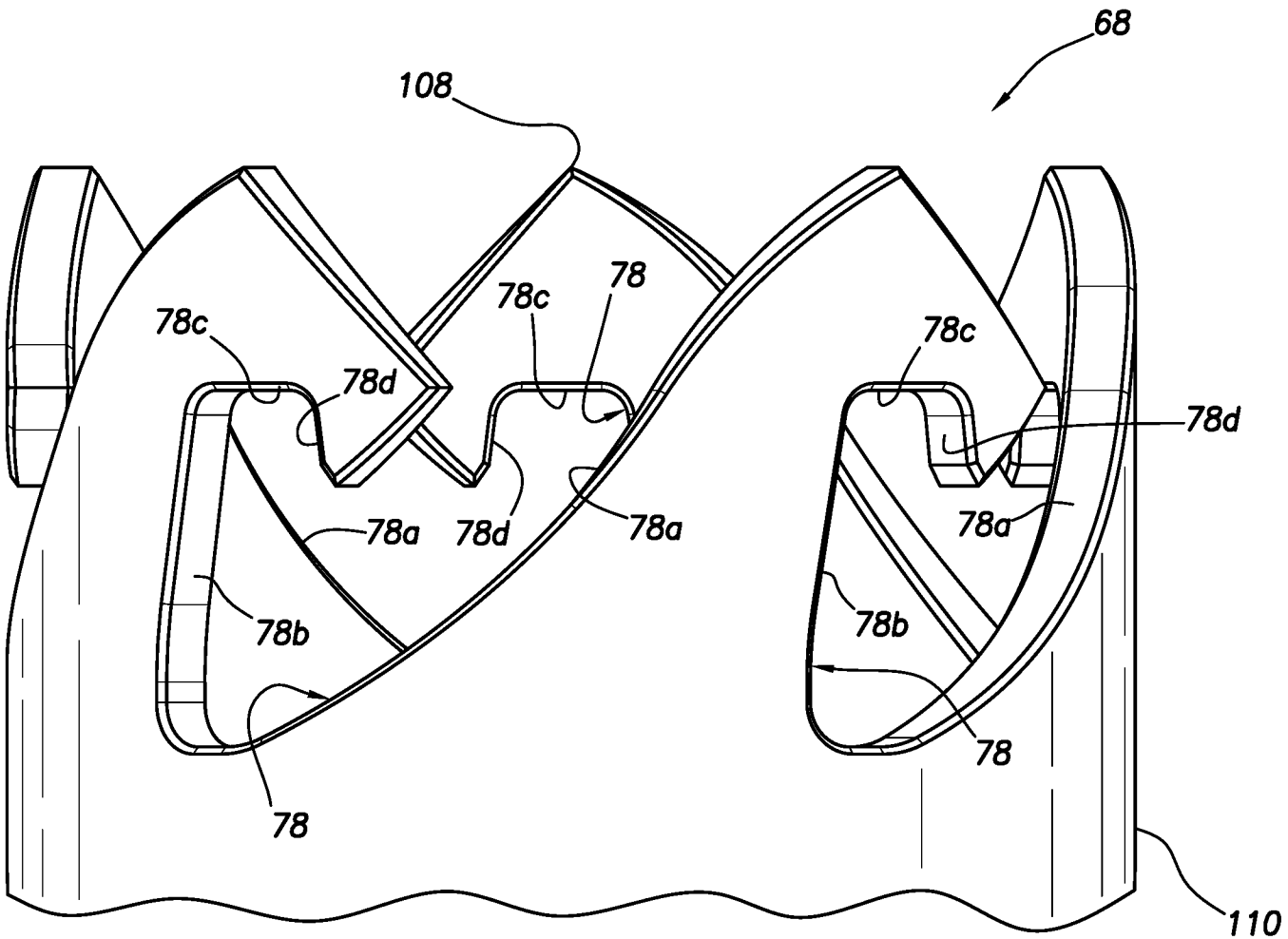
FIG. 10 is a representative elevational view of an example of an engagement profile of the releasable assembly.

Referring additionally now to FIG. 10, an elevational view of an upper portion of the extension 68 is representatively illustrated. In this view, a configuration of the engagement profiles 78 is more clearly seen.

Five of the engagement profiles 78 are formed at an upper end 108 of the extension 68 as depicted in FIG. 10, but other numbers and other positions may be used for the profiles 78 in other examples. Thus, the scope of this disclosure is not limited to any particular configuration, position or other detail of the profiles 78 described herein or depicted in the drawings.

The engagement profiles 78 in the FIG. 10 example comprise slots formed completely through a wall 110 of the extension 68. Each of the profiles 78 has a "J" shape, with a section 78*a* extending longitudinally upward to intersect the upper end 108 of the extension 68. The section 78*a* provides for entry and exit of a lug 76 (see FIG. 3) respectively to and from a corresponding profile 78.

Note that the sections 78*a* extend longitudinally in the extension 68, but also extend circumferentially, so that the sections 78*a* have a generally helical shape. Thus, engagement between the lugs 76 and the profile sections 78*a* can produce rotation of the lugs (for example, if the lugs are displaced longitudinally downward into contact with the profile sections 78*a*), or rotation of the lugs relative to the profile sections can provide for longitudinal displacement of the lugs relative to the profile sections (for example, if the lugs are rotated into contact with the profile sections).

Another section 78*b* of the profile 78 extends longitudinally in the extension 68. In this example, the profile sections 78*a,b* are substantially continuous, with a transition joining lower ends of the sections. However, in other examples, additional profile sections may be interposed between the sections 78*a,b* (for example, a circumferentially extending section could be formed between the profile sections 78*a,b*).

Another section 78*c* of the profile 78 extends circumferentially from an upper end of the profile section 78*b*. The profile sections 78*c* provide abutments for preventing disengagement of the lugs 76 from the profiles 78. When the lugs 76 are engaged with the profiles 78, and the releasable assembly 40 is thereby suspended from the running tool 50, a weight of the releasable assembly is applied to the running tool via contact between the lugs and the profile sections 78*c*.

Another section 78*d* of the profile 78 extends longitudinally downward from an end of the profile section 78*c*. When the lugs 76 are engaged with the profiles 78, and the releasable assembly 40 is thereby suspended from the running tool 50 (with the lugs contacting the profile sections 78*c*), the lugs are retained circumferentially between the corresponding profile sections 78*b,d*.

Thus, in order to disengage the lugs 76 from the profiles 78, the lugs must displace longitudinally downward relative to the profiles (for example, by landing the releasable assembly 40 in the outer housing 26 and activating the latch 46 to secure the releasable assembly in the outer housing during the installation operation, see FIG. 2). The lugs 76 are then rotated (counter-clockwise as viewed from above) relative to the profiles 78, so that the lugs can follow the profile sections 78*a* helically upward to the upper end 108 of the extension 68.

Preferably, the running tool 50 is displaced upward during this rotation (e.g., by picking up on the tubular string 20 at the surface), so that a weight of the tubular string is not bearing on the profiles 78 as the lugs 76 follow the profile sections 78*a*. Relative rotation between the lugs 76 and the profiles 78 is permitted during this installation operation, since relative rotation is permitted between the drive hub 80 and the inner mandrel 86 of the running tool 50 (see FIGS. 6-9).

An opposite sequence of steps may be used to retrieve the releasable assembly 40 from the outer housing 26 (and the remainder of the riser string 12). More specifically, the running tool 50 can be connected in the tubular string 20, and then conveyed downward through the riser string 12 to the releasable assembly 40. The running tool 50 can be displaced longitudinally downward toward the releasable assembly 40, so that the lugs 76 eventually enter the profiles 78 and follow the profile sections 78*a* to their lower ends.

The lugs 76 can rotate relative to the profiles 78, since relative rotation is permitted between the drive hub 80 and the inner mandrel 86 of the running tool 50 (see FIGS. 6-9).

Subsequent upward displacement of the running tool 50 (for example, by picking up on the tubular string 20 at the surface) will cause the lugs 76 to contact the profile sections 78*c*, and will cause the lugs to be retained circumferentially between the profile sections 78*b,d*. Right-hand rotation (clockwise as viewed from above) may be applied to the tubular string 20 while picking up, to ensure that the lugs 76 remain retained in the profiles 78. The latch 46 can then be deactivated to permit the releasable assembly 40 to be conveyed upward out of the outer housing 26 and the riser string 12 to the surface on the running tool 50.

It may now be fully appreciated that the above disclosure provides significant advancements to the art of installing and retrieving releasable assemblies of well pressure control devices. In examples described above, the running tool 50 can be used to conveniently install and retrieve the releasable assembly 40, with the clutch device 88 permitting but resisting relative rotation between the drive hub 80 and the inner mandrel 86 as the lugs 76 engage with, or disengage from, the profiles 78.

The above disclosure provides to the art a method of installing a well pressure control device releasable assembly 40 in an outer housing 26. In one example, the method comprises: engaging an engagement lug 76 of a running tool 50 with an engagement profile 78 of the releasable assembly 40; connecting the running tool 50 in a tubular string 20; conveying the releasable assembly 40 with the running tool 50 into the outer housing 26; latching the releasable assembly 40 in the outer housing 26; and then rotating the tubular string 20, thereby disengaging the engagement lug 76 from the engagement profile 78.

The rotating step can include producing relative rotation between the engagement lug 76 and an inner mandrel 86 of the running tool 50. The relative rotation may be resisted by a clutch device 88 of the running tool 50.

The disengaging step can include displacing the running tool 50 longitudinally away from the releasable assembly 40 while the tubular string 20 is rotating.

The method can include forming the engagement profile 78 in a generally tubular extension 68 attached to an outer case 64 of a bearing assembly 44 of the releasable assembly 40. The forming step can include forming the engagement profile 78 proximate an end 108 of the extension 68, the engagement profile 78 comprising at least first and second longitudinally elongated sections 78*a,b*. The first section 78*a* may extend to the end 108 of the extension 68, and the second section 78*b* may be blocked from the end 108 of the extension 68 (for example, by the profile sections 78*c,d*).

The engagement profile 78 may comprise a continuous slot formed proximate the end 108 of the extension 68, with the first and second sections 78*a,b* being portions of the slot.

The above disclosure also provides to the art a system 10 for use with a subterranean well. In one example, the system 10 can include a pressure control device 48 including a releasable assembly 40 and an outer housing 26, with the releasable assembly 40 being releasably securable in the outer housing 26, and a running tool 50 that conveys the releasable assembly 40. The running tool 50 can include at least one engagement lug 76 releasably engaged with an engagement profile 78 of the releasable assembly 40, an inner mandrel 86 rotatable relative to the engagement lug 76, and a clutch device 88 that resists relative rotation between the engagement lug 76 and the inner mandrel 86.

The clutch device 88 may include a friction enhancing material 90*a* interposed between the engagement lug 76 and the inner mandrel 86.

The engagement lug 76 may be secured against rotation relative to a drive hub 80, a friction enhancing material 90*a* may be secured against rotation relative to the inner mandrel 86, and a biasing device 92 may bias the friction enhancing material 90*a* against the drive hub 80.

The releasable assembly 40 may include at least one annular seal 42 that sealingly engages a tubular string 20 positioned in the releasable assembly 40. The running tool 50 may be connected in the tubular string 20.

The releasable assembly 40 may include a bearing assembly 44 that rotatably supports the annular seal 42 relative to a generally tubular outer case 64 of the bearing assembly 44, and a generally tubular extension 68 attached to the outer case 64, with the engagement profile 78 being proximate an end 108 of the extension 68. The engagement profile 78 may comprise at least first and second longitudinally elongated sections 78*a,b*, with the first section 78*a* extending to the end 108 of the extension 68, and the second section 78*b* being blocked from the end 108 of the extension 68.

The engagement profile 78 may comprise a continuous slot formed proximate the end 108 of the extension 68, with the first and second sections 78*a,b* being portions of the slot.

The outer case 64 may include an external latch profile 66. The extension 68 may be attached to the outer case 64 between the engagement profile 66 and the external latch profile 66.

A pressure control device 48 for use with a subterranean well is also described above. In one example, the pressure control device 48 can include at least one annular seal 42, a bearing assembly 44 that rotatably supports the annular seal 42 relative to a generally tubular outer case 64 of the bearing assembly 44, and a generally tubular extension 68 attached to the outer case 64, the extension 68 having at least one engagement profile 78 proximate an end 108 of the extension 68, the engagement profile 78 comprising at least first and second longitudinally elongated sections 78*a,b*, the first section 78*a* extending to the end 108 of the extension 68, and the second section 78*b* being blocked from the end 108 of the extension 68.

The first and second sections 78*a,b* may be configured to releasably engage an engagement lug 76 of a releasable assembly running tool 50.

The engagement profile 78 may comprise a continuous slot formed proximate the end 108 of the extension 68, the first and second sections 78*a,b* being portions of the slot.

The combined first and second sections 78*a,b* may be "J" shaped.

The engagement profile 78 may be formed completely through a wall 110 of the extension 68. In other examples, the profile 78 could be formed only partially through the wall 110 (such as, formed on an inner surface of the extension 68).

The first section 78*a* may extend helically between the second section 78*b* and the end 108 of the extension 68.

The outer case 64 may include an external latch profile 66. The extension 68 may be attached to the outer case 64 between the engagement profile 78 and the external latch profile 66.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of installing a well pressure control device releasable assembly in an outer housing, the method comprising:

engaging an engagement lug of a running tool with an engagement profile of the releasable assembly;

connecting the running tool in a tubular string;

conveying the releasable assembly with the running tool into the outer housing;

latching the releasable assembly in the outer housing; and then rotating the tubular string, thereby disengaging the engagement lug from the engagement profile, in which the rotating comprises producing relative rotation between the engagement lug and an inner mandrel of the running tool, in which the relative rotation is resisted by a clutch device of the running tool, and in which the disengaging comprises displacing the running tool longitudinally away from the releasable assembly while the tubular string is rotating.

2. The method of claim 1, further comprising forming the engagement profile in a generally tubular extension attached to an outer case of a bearing assembly of the releasable assembly.

3. The method of claim 2, in which the forming comprises forming the engagement profile proximate an end of the extension, the engagement profile comprising at least first and second longitudinally elongated sections, the first section extending to the end of the extension, and the second section being blocked from the end of the extension.

4. The method of claim 3, in which the engagement profile comprises a continuous slot formed proximate the end of the extension, the first and second sections being portions of the slot.

5. A system for use with a subterranean well, the system comprising:

a pressure control device including a releasable assembly and an outer housing, the releasable assembly being releasably securable in the outer housing; and a running tool that conveys the releasable assembly, the running tool including at least one engagement lug releasably engaged with an engagement profile of the releasable assembly, an inner mandrel rotatable relative to the engagement lug, and a clutch device that resists relative rotation between the engagement lug and the inner mandrel.

6. The system of claim 5, in which the clutch device comprises a friction enhancing material interposed between the engagement lug and the inner mandrel.

7. The system of claim 6, in which the engagement lug is secured against rotation relative to a drive hub, the friction enhancing material is secured against rotation relative to the inner mandrel, and a biasing device biases the friction enhancing material against the drive hub.

8. The system of claim 5, in which the releasable assembly includes at least one annular seal that sealingly engages a tubular string positioned in the releasable assembly, and in which the running tool is connected in the tubular string.

9. The system of claim 8, in which the releasable assembly further includes a bearing assembly that rotatably supports the annular seal relative to a generally tubular outer case of the bearing assembly, and a generally tubular extension attached to the outer case, the engagement profile being proximate an end of the extension, the engagement profile comprising at least first and second longitudinally elongated sections, the first section extending to the end of the extension, and the second section being blocked from the end of the extension.

10. The system of claim 9, in which the engagement profile comprises a continuous slot formed proximate the end of the extension, the first and second sections being portions of the slot.

11. The system of claim 9, in which the outer case includes an external latch profile, and in which the extension is attached to the outer case between the engagement profile and the external latch profile.

12. A pressure control device for use with a subterranean well, the pressure control device comprising:

at least one annular seal;

a bearing assembly that rotatably supports the annular seal relative to a generally tubular outer case of the bearing assembly; and a generally tubular extension attached to the outer case, the extension having at least one engagement profile proximate an end of the extension, the engagement profile comprising at least first and second longitudinally elongated sections, the first section extending to the end of the extension, and the second section being blocked from the end of the extension, in which the engagement profile is formed completely through a wall of the extension.

13. The pressure control device of claim 12, in which the first and second sections are configured to releasably engage an engagement lug of a releasable assembly running tool.

14. The pressure control device of claim 12, in which the engagement profile comprises a continuous slot formed proximate the end of the extension, the first and second sections being portions of the slot.

15. The pressure control device of claim 12, in which the combined first and second sections are "J" shaped.

16. The pressure control device of claim 12, in which the first section extends helically between the second section and the end of the extension.

17. The pressure control device of claim 12, in which the outer case includes an external latch profile, and in which the extension is attached to the outer case between the engagement profile and the external latch profile.

* * * * *